United States Patent [19]

Dean et al.

[11] 4,434,049

[45] Feb. 28, 1984

[54] RESIDUAL OIL FEED PROCESS FOR FLUID CATALYST CRACKING

[76] Inventors: Robert R. Dean, #1 Columbine La., Littleton, Colo. 80123; Jean L. Mauleon, 15656 E. Grand Ave., Aurora, Colo. 80015; Robert J. Newman, 8586 E. Otero Cir., Englewood, Colo. 80112

[21] Appl. No.: 359,156

[22] Filed: Mar. 17, 1982

[51] Int. Cl.[3] ..... C10G 11/18

[52] U.S. Cl. ..... 208/153; 208/113; 208/157

[58] Field of Search ..... 208/113, 153, 157

[56] References Cited

U.S. PATENT DOCUMENTS

| | | | |
|---|---|---|---|
| 2,937,988 | 5/1960 | Polack | 208/157 X |
| 2,952,619 | 9/1960 | Metrailer et al. | 208/157 |
| 3,071,540 | 1/1963 | McMahon et al. | 208/157 X |
| 3,152,065 | 10/1964 | Sharp et al. | 208/157 |
| 3,246,960 | 4/1966 | Sharp et al. | 208/153 X |
| 3,607,730 | 9/1971 | Pfeiffer | 208/153 X |
| 3,654,140 | 4/1972 | Griffel et al. | 208/113 |
| 4,097,243 | 6/1978 | Bartholic | 208/113 X |
| 4,259,175 | 3/1981 | McArthur | 208/113 |
| 4,332,673 | 6/1982 | Myers | 208/113 X |

OTHER PUBLICATIONS

Perry, "Chemical Engineer's Handbook", 5th ed., McGraw Hill, 1973, pp. 18–58 to 18–65.

*Primary Examiner*—Delbert E. Gantz
*Assistant Examiner*—Glenn Caldarola
*Attorney, Agent, or Firm*—Carl D. Farnsworth

[57] ABSTRACT

The invention described is directed to the fluid catalytic conversion of hydrocarbons and is concerned particularly with the method and means for obtaining atomized-vaporized contact of residual oils and reduced crudes with high temperature dispersed phase fluid catalyst particles. More particularly, one embodiment of the invention is directed to atomizing an oil-water emulsion thereafter discharged into up-flowing dispersed phase catalyst particles at velocities up to sonic velocities to form a suspension under hydrocarbon conversion conditions.

23 Claims, 2 Drawing Figures

RESIDUAL OIL FEED PROCESS FOR FLUID CATALYST CRACKING

BACKGROUND OF THE INVENTION

This invention relates to the fluid catalytic conversion of hydrocarbons and the improved method and use of a particular feed atomizing injector or nozzle means for obtaining intimate atomized contacting of a gas oil and/or a high boiling residual oil feed material with finely divided fluid catalyst particles. More particularly, the contact conditions are selected to obtain substantially instantaneous vaporized-atomized contact of the charged oil feed with fluid catalyst particles of desired elevated temperature for conversion in a hydrocarbon conversion zone to hydrocarbon products comprising gasoline, gasoline precursors, and obtain a reduction in dry gas and coke make. The oil feed which may be processed by the technique of the invention is a portion of a crude oil such as a gas oil with or without a higher boiling hydrocarbon feed portion which may comprise metallo-organic compounds and substantial Conradson carbon producing components boiling above about 1025° F. Such a hydrocarbon feed may be high boiling residual oil portions of crude oil which are referred to in the literature by a number of different terms as a low API gravity oil, topped crude, reduced crudes, heavy residual oils, vacuum gas oil comprising resid components, and high boiling residual hydrocarbons comprising metallo-organic compounds. These are among the several terms used in the prior art.

In the prior art of U.S. Pat. No. 3,547,805 the hydrocarbon oil feed is charged to the system by injecting it by an annulus surrounding a stream of water. This system is concerned with atomizing the oil feed and mixing it with steam.

U.S. Pat. No. 3,152,065 discloses feed injector arrangements which include an inner pipe for passing steam and an outer pipe forming an annulus for passing oil feed which is mixed in a smaller diameter opening in the end of the outer pipe displaced apart from the open end of the inner steam pipe. The patent also discloses placing curved stator vanes in the annulus adjacent to the end of the steam pipe. The feed nozzle combination may be used in the bottom of a riser or in the wall of the riser above the catalyst inlet thereto.

Figure 1:
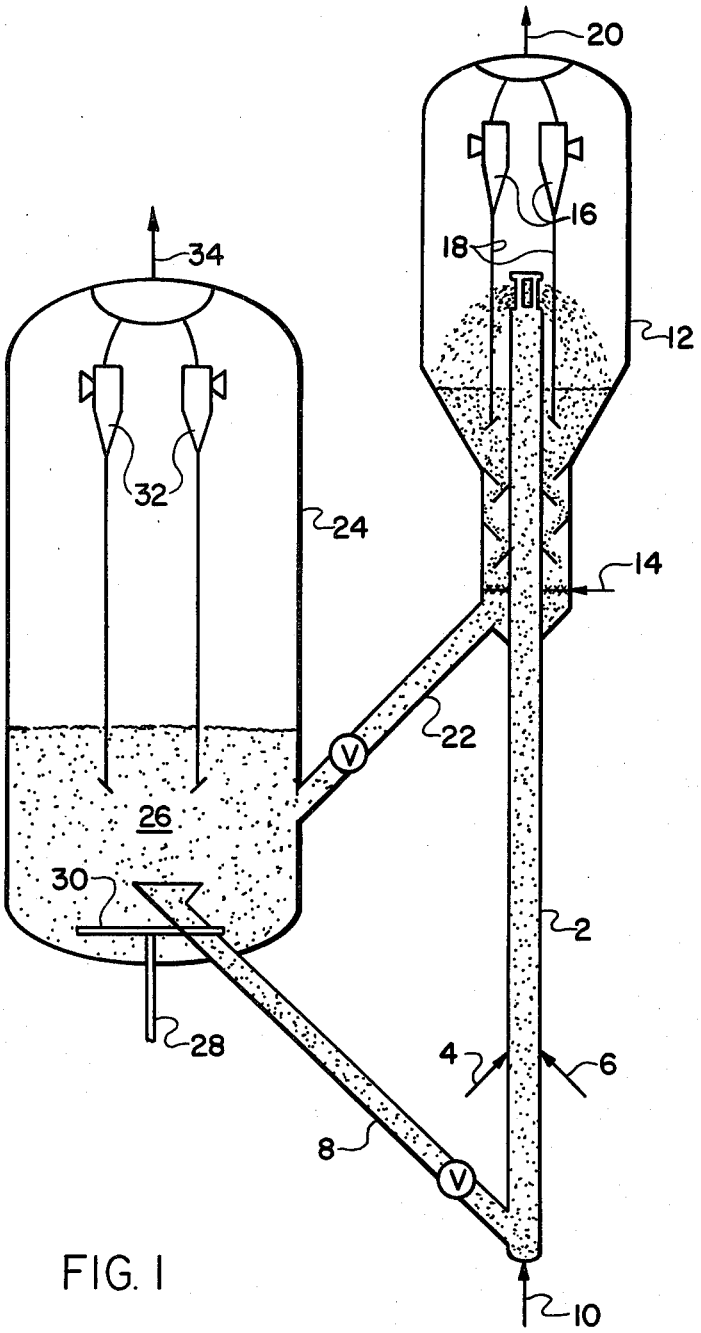
Figure 2:
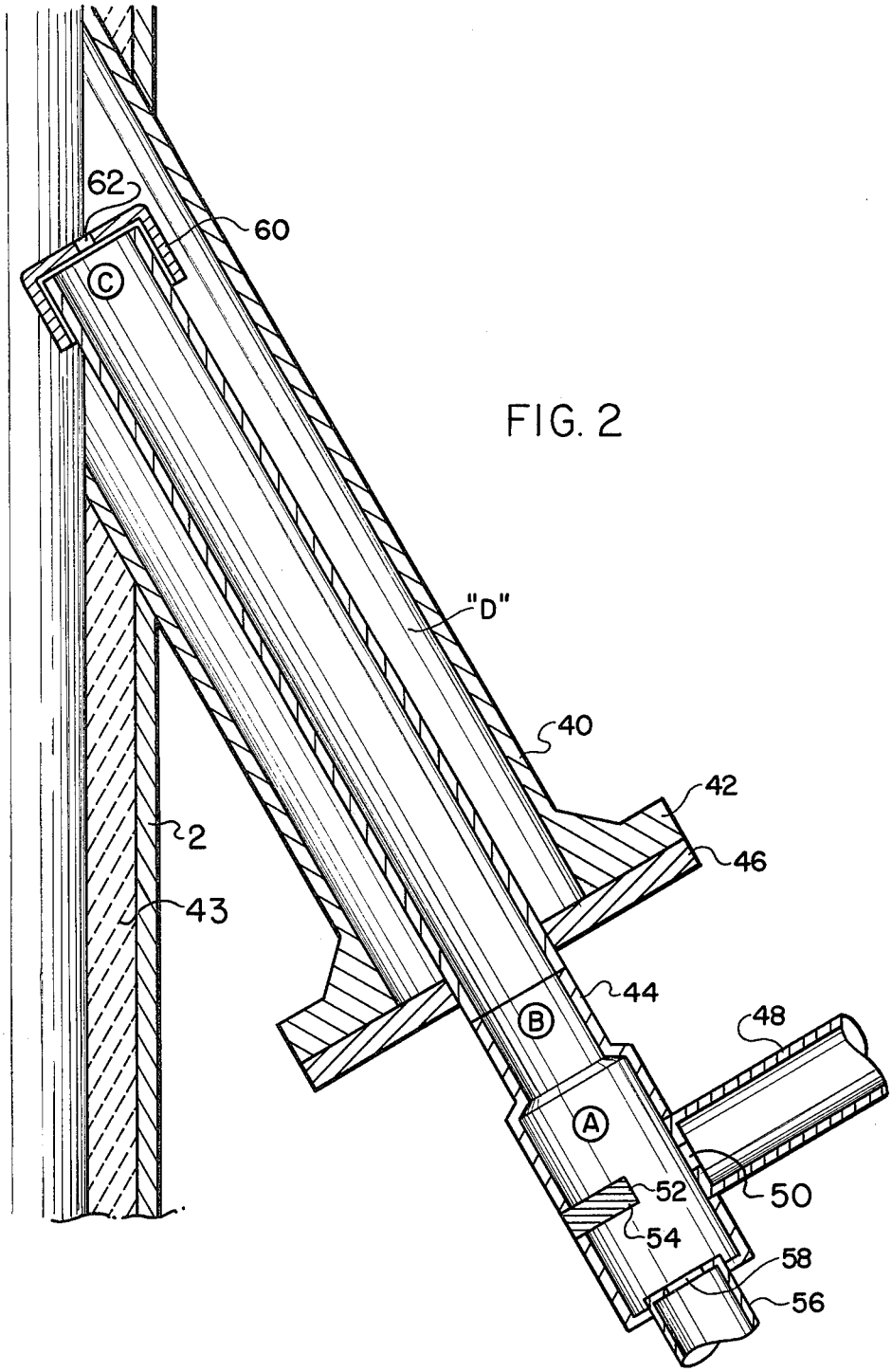

U.S. Pat. No. 3,654,140 is directed to a novel cat cracking oil feed injector design concurrently feeding steam to the injection zone in a volumetric ratio of steam to liquid hydrocarbons ranging from about 3 to 75, thereby imparting to the resulting mixture an exit velocity relative to the fluidized catalyst of at least about 100 feet per second whereby the oil feed stock is essentially completely atomized at the nozzle exit forming droplets less than about 350 microns in diameter. The nozzle exit of each of FIGS. 1 and 2 are shown extended a substantial distance into the reaction zone where upflowing dispersed phase catalyst can be attrited and/or erode the nozzle end.

U.S. Pat. No. 3,812,029 contemplates a nozzle arrangement similar to U.S. Pat. No. 3,071,540 except that the outer tube is used to inject water at a temperature and flow rate lower than that of oil feed in the center tube. An article in the *Oil and Gas Journal* for Mar. 30, 1981 entitled, "Burst of Advances Enhance Cat Cracking", by D. F. Tolen, reviews in considerable detail some problems facing modern day refiners processing residual oils and comprising metal contaminants and Conradson carbon producing components boiling above vacuum gas oils. The subjects briefly discussed include catalysts suitable for resid cracking in the presence of metal contaminants; the effect of metal contaminants on product selectivity; the addition of steam and/or water with the feed; catalyst regeneration; feed quality; combustion promoters used during regeneration of the catalyst to remove carbonaceous deposits and obtain desired regeneration catalyst temperature profiles and identifies problems associated with sulfur and nitrogen oxides in the feed and combustion flue gases. This article further identifies the need to obtain good mixing of the feed with catalyst in a riser reactor. In this catalytic-hydrocarbon conversion environment, good mixing is said to reduce gas make, increase gasoline selectivity, and improve catalytic cracking in preference to thermal cracking and reduce carbon formation.

The prior art identified operating parameters are intended to accelerate a mixture relatively uniformly with a feed vaporization section of a riser reactor zone in a minimum time frame and thus enhance rapid heat transfer from hot catalyst particles to charged feed, preferably atomized, and thus prevent localized enhanced catalyst to oil ratios contributing to a dense catalyst bed phase. That is, the operating conditions and methods for implementing are selected to ensure a relatively dilute phase suspension formation between catalyst particles and atomized oil feed for vaporized conversion transfer through a riser conversion zone. Such dilute catalyst phase operations include catalyst particle concentrations in the range of 0.5 to 10 pounds per cubic foot and preferably not above about 5 pounds per cubic foot.

SUMMARY OF THE INVENTION

The present invention is directed to an improved and novel oil feed device or apparatus arrangement means and the method of use thereof for achieving intimate high temperature atomized and substantially instantaneous vaporized contact between a relatively high boiling oil feed material with suspended hot fluid catalyst particles. More particularly, a suspension is formed in a riser conversion zone under selected conditions of temperature, hydrocarbon-catalyst ratio, and contact time by charging a residual oil feed providing a selective catalytic cracking thereof to desired products.

In a hydrocarbon conversion-catalyst regeneration operation comprising an atomized oil feed preparation method of this invention, a residual oil fraction of crude oil providing a gravity in the range of from about 5 to about 28 API gravity and an initial boiling point generally including gas oils and higher boiling material is contacted with fluid cracking catalyst particles of desired elevated temperature in the presence of one or more diluent materials such as water, steam or other suitable noramally gaseous hydrocarbon material in an amount sufficient to provide a hydrocarbon feed partial pressure within the range of 10 to 50 psia in a riser contact zone. A hydrocarbon feed contact time with relatively high temperature catalyst particles in the riser conversion zone is generally restricted to less than 4 seconds and more usually is restricted to within the range of 0.5 to 2 seconds. In this operating mode or relationship, the suspension formed between fluidized catalyst particles and charged atomized oil feed material comprising diluent material is formed with a dispersed phase of catalyst particles maintained at a particle concentration within the range of 0.5 to 10 pounds of catalyst particles per cubic foot of the riser reactor. In a particular operating embodiment it is desirable to mix water, up to about 2 weight percent, with the heavy oil feed to form a stable, fine emulsion of water and oil. This formed emulsion has the advantage of reducing the oil surface tension for more easy atomization. The hydrocarbon feed admixed with water and/or steam is preheated to an elevated temperature up to about 800° F. but heating of the oil feed is restricted to avoid any substantial thermal cracking thereof. More preferably, the contact of atomized oil feed with hot regenerated fluid catalyst particles is particularly accomplished to form a highly, if not completely vaporized oil-catalyst particle mix temperature thereof in the riser approaching or at least substantially equal to the pseudo-critical temperature of the residual oil feed. On the other hand, the temperature of the atomized residual oil feed discharged by the method of the special feed nozzle arrangement of this invention provides substantially instantaneous vaporized intimate contact with hot dispersed phase catalyst particles in the riser. The mix temperature utilized preferably provides substantially instantaneous vaporization of a charged high boiling residual oil feed material comprising metallo-organic compounds in the presence of an atomizing gaseous diluent material.

The unique and special atomizing feed nozzle arrangement of this invention and disclosed herein, provides a highly atomized oil feed mixture generally in the range of 10 to 500 micron size droplets and particularly suitable for processing a low API gravity high boiling residual oil feed material comprising metallo-organic compounds in the presence of a gaseous material which may be active or non-reactive in the catalyzed hydrocarbon conversion zone. The finely atomized mixture of an oil-water emulsion in a gaseous or gasiform diluent material and obtained as herein provided is discharged from a restricting orifice at a velocity up to and including sonic velocities as a finely atomized droplet spray pattern into a riser reactor for intimate vaporized contact with an upflowing dispersed phase fluid mass of hot particles of catalyst in a fluidizing gas. The atomized oil droplet spray pattern discharged from the restricting orifice is selected to achieve an atomized oil droplet dispersion or scatter of at least 30 degrees up to about 120 degrees within the riser cross section. This atomized oil droplet scatter and contact with hot fluid catalyst particles very rapidly initiates vaporization of the oil feed and catalytic cracking thereof. A fluidizing medium suitable for providing the dispersed catalyst phase and that used as diluent to atomize the oil feed is one which may or may not be inert during conversion of the heavy oil feed at the cracking condition selected. However, since the residual oil composition may comprise metallo-organic compounds, the diluent may preferably be of a composition which enters into the cracking reaction to reduce or promote hydrogen production, hydrogen transfer reactions and deactivate accumulated metals on catalyst particles at a temperature up to 1400° F. or higher. The temperature requirements of the riser hydrocarbon conversion operation contemplated herein will vary with feed composition and source. Therefore, the hydrocarbon conversion temperature is selected to form a hydrocarbon-diluent-catalyst suspension mixture initially comprising substantially completely vaporized residual oil feed in contact with catalyst particles for the recovery of a hydrocarbon conversion product-catalyst suspension thereof at a temperature above 950° F. Thus the suspension temperature is one closely related to the boiling point of a given or particular hydrocarbon feed being processed and preferably the suspension temperature is preferably at least equal to the pseudo-critical temperature of the highly atomized hydrocarbon oil charged as feed to the riser hydrocarbon conversion zone.

The method of atomizing the oil feed and the apparatus arrangement utilized to accomplish such atomization is one designed to particularly break up and form a highly atomized oil feed of less than 500 micron size droplets in an atomizing zone external to a riser reactor and thereafter the atomized oil with atomizing diluent material is passed through a transfer barrel or conduit such as an elongated confined transfer zone into the riser reaction zone as relatively fine oil droplets representing an oil mist or fog in gaseous diluent material. A restricting orifice which is round, slotted or square is provided at the end of the transfer zone for discharging atomized oil mist into the reaction zone. In the nozzle arrangement of this invention, atomization of oil droplets initially formed by impact is further effected by the shearing action of a suitable velocity and expanded gaseous diluent material stream charged to the nozzle body at a substantial angle away from the oil feed inlet stream thereto thereby forming even finer micron size and atomized droplets of the oil feed in the nozzle barrel and dispersed in gaseous material. The thus formed highly atomized oil-diluent mist comprising relatively fine micron size droplets less than 500 microns is then passed through an elongated zone comprising the barrel of the nozzle body to a shape selected orifice opening in the end of the barrel. This discharge orifice opening is of a size and shape selected to produce further shearing of the fog of oil droplets passed thereto and to particularly provide a predetermined and desired spray pattern or dispersion of the atomized oil droplets into the riser reactor for rapid intimate vaporization contact with the upflowing fluid particles of catalyst at a desired elevated temperature and in a concentration sufficient to act as a curtain of particles between the nozzle outlet and the riser wall. The nozzle opening is preferably located adjacent the riser inner wall surface but not sufficiently beyond the inside surface or wall thereof to provide substantial attrition of upflowing catalyst particles. The nozzle opening is sufficiently restricted to achieve exit velocities therefrom up to and including sonic velocities.

In the specific nozzle apparatus arrangement of this invention, a charged emulsion of residual oil preferably mixed with up to two (2) weight percent of water and preheated up to about 800° F. is passed through a first orifice means or restricted opening in the nozzle as a stream of oil for impingement upon a raised preferably round surface area which may be flat, slightly convex or concave and positioned substantially directly opposite the first orifice opening emitting an oil stream to obtain upon impact with the surface initial formation of relatively small oil droplets. Further atomization of the oil droplets thus formed by impact or impingement or the round surface is obtained by providing a relatively high velocity gaseous material stream such as one of steam, $CO_2$, or a mixture thereof in shearing contact with the initially formed oil droplets to thereby produce even finer atomized oil droplets less than 500 microns size distributed in gaseous diluent material and referred to herein as an oil-diluent mist thus formed is then passed through a sufficiently elongated confined passageway or barrel to a particularly sized orifice or slotted opening in the end of the barrel adjacent the riser wall inner surface which will produce a further shearing of oil droplets and/or re-shearing of any oil droplets which may have coalesced during travel through the barrel. A preselected and desired spray pattern of atomized oil droplets over the range of 15 to 120 degrees is provided by a selected orifice opening at the end of the barrel. The atomized oil droplets in contact with upflowing fluid particles of catalyst are in a concentration preferably preventing any substantial significant undesired contact of atomized hydrocarbons with the wall of the riser contact zone opposite the nozzle discharge. Thus, the very fine atomized dispersion of residual oil feed, nozzle discharge velocity and spray pattern, fluid catalyst particle concentration and temperature cooperatively contribute to achieving desired instantaneous vaporized contact between oil droplets and catalyst particles for more optimum conversion of a selected residual oil feed material which may or may not comprise components boiling above vacuum gas oils.

It is contemplated employing one or more of the atomizing nozzle arrangements of this invention penetrating the wall of a given riser reactor contact zone such as two or more nozzle arrangements herein identified separately positioned about the riser periphery and generally opposite one another to achieve a desired spray pattern of atomized oil droplets across the riser cross section. In a particular embodiment, the nozzles penetrate the riser wall above the fluidizing gas and regenerated catalyst particle inlet to the riser reactor. It is also contemplated however employing one or more of the nozzle arrangements of this invention penetrating a bottom cross section of the riser reactor on an axis at least parallel to the riser axis and housed as required in a heat dissipating sleeve member so that catalyst particles charged to the riser may be brought in fluidized contact with substantially only the atomized oil droplet sprayed into the riser from the nozzle discharge orifice according to this invention. It is also contemplated housing the nozzle barrel in a stream of heat dissipating gaseous material particularly when hot particles of catalyst can come in contact with the nozzle barrel in order to minimize thermal cracking of the charged atomized oil feed.

When employing a very fine dispersion of oil droplets in gaseous diluent as herein identified and particularly preferred, the liquid droplet does not necessarily need to come in direct contact with hot catalyst particles to obtain rapid vaporization thereof. Heat flows rapidly by thermal conduction from the hot catalyst particles in the riser reactor to the atomized oil stream and very rapidly vaporizes the fine liquid droplets before direct cracking contact with the catalyst particles. Of further particular interest is the finding that the nozzle design of the invention is not subject to undue wear or plugging when properly utilized as there are no unduly fine restricting orifices or moving parts and no direct impingement of a heavy or high boiling residual oil liquid at a high velocity through a restricted opening as is the normal practice and particularly taught by U.S. Pat. No. 3,654,140. Optimum atomization of the oil feed is achieved in at least a two-stage arrangement at oil viscosities generally in the range of 1 to about 20 centistokes, preferably 2 to 5 centistokes in the presence of a dispersion gas such as steam averaging from 1 to 10 weight percent in the oil-steam mixture. An orifice opening of selected size and shape such as a round or a slotted opening comprising one or more slots on the end of the nozzle barrel is relied upon particularly for obtaining a more particularly desired angle of spray of the atomized oil-diluent fog material passed through the nozzle barrel and initially formed in the external nozzle mixing zone. The velocity of the finely atomized oil fog discharged from the nozzle end is at least 25 feet per second and preferably substantially higher velocities up to and including sonic velocities are contemplated. Since the atomized oil feed-diluent fog or mist mixture in the nozzle barrel is more completely atomized upon discharge from the nozzle opening into the upflowing dispersed fluid catalyst phase in the riser there is little, if any, possibility of the highly atomized heavy oil feed channeling through the upflowing fluidized catalyst particles in the riser and thus out of desired contact with catalyst particles. Furthermore, the velocity or momentum differential of the component of the formed suspension is not sufficient for causing undesired separation of suspension components or substantial attrition of entrained upflowing catalyst particles.

A most important advantage of the residual oil feed preliminary atomizing section of the nozzle system or apparatus of this invention is that it can be and is preferably located substantially to the exterior or on the external side of the riser reactor except for a short portion of the barrel portion and tip thereof. The tip of the nozzle is located essentially flush with the inside surface of the riser refractory lining material thus providing for easy maintenance of the nozzle and ensuring that no undesired coking, plugging and attrition problems at the nozzle tip will develop or interfere with catalyst flow. The feed atomization and desired injection thereof may be further assured by the use of a pipe sleeve means rigidly attached to the riser wall and extending through the riser lining to its internal surface. The sleeve is preferably of a diameter larger than the nozzle barrel diameter sufficient to provide an annular space therewith which may be flushed continuously or periodically with steam or other fluidizing gas. The sleeve is provided with suitable flange means or an annular member for quickly and rigidly fastening the nozzle system comprising a matching flange within the pipe sleeve. The nozzle sleeve assembly may be arranged generally perpendicular to the riser wall or sloped upwardly to within about 30 degrees of the riser wall as specifically shown in the drawings.

The drawing, FIG. 1, is a diagrammatic sketch in elevation of an arrangement of apparatus comprising a riser reactor zone adjacent to a catalyst regeneration zone with interconnecting conduit means to provide circulation of catalyst between zones.

FIG. 2 is a diagrammatic sketch in elevation of a preferred feed nozzle arrangement showing the positioning of the nozzle apparatus in a wall of a riser conversion zone and particularly located within a sleeve member penetrating the wall of the riser zone.

DISCUSSION OF SPECIFIC EMBODIMENTS

Referring now to FIG. 1 by way of example, there is shown a riser reaction zone 2 to which a mixture of atomized hydrocarbon feed and atomizing diluent material obtained as herein provided is charged by conduit means 4 and 6 representing the specific nozzle system of FIG. 2 of this invention. Hot finely divided catalyst particles obtained from a catalyst regeneration zone 24 by conduit 8 are charged to a lower bottom portion of riser 2 for admixture with a suitable fluidizing gas such as steam, $CO_2$, FCCU off gases, or mixtures thereof, introduced by conduit 10. The fluidizing gas may be substantially any gaseous material considered active or inert to a residual oil hydrocarbon conversion operation. It may be one which participates in achieving a more particularly desired and selective conversion of the residual oil feed as herein provided. A suspension of atomized-vaporized hydrocarbons and diluent obtained as herein provided comprising fluidizable catalyst particles recovered at an elevated regeneration temperature in the range of 1350° F. up to about 1400° F., 1600° F., and as high as about 1800° F. is formed in the presence of one or more diluent materials selected to achieve a desired conversion of the hydrocarbon feed to gasoline, gasoline precursors and other desired hydrocarbon conversion products during traverse of the riser reactor contact zone in a time frame selected from within the range of 0.5 second up to about 4 seconds, but normally not above about 2 seconds. The upwardly flowing high temperature suspension of hydrocarbon conversion vapors, diluent and catalyst particles in riser 2 is discharged from the upper end of the riser reaction zone under conditions to achieve a rapid separation of catalyst particles from hydrocarbon vapors and diluent material. The separated catalyst is collected as a bed of catalyst in a bottom portion of vessel zone 12 in open communication with a lower annular stripping zone therebelow through which collected catalyst is downwardly passed countercurrent to stripping gas charged by conduit 14 to a bottom portion thereof. The stripping zone need not be annular and may be located to the side of the riser reactor as known in the prior art as a cylindrical stripping zone. Vaporous hydrocarbons and diluent gaseous materials, fluidizing and stripping gases such as steam, $CO_2$ and mixtures thereof are passed through one or more cyclone separation zones or separators 16 comprising diplegs 18 provided in vessel 12 to effect a further separation of entrained catalyst particles from vaporous material comprising gaseous materials and vaporous hydrocarbon conversion products. Vaporous hydrocarbons are recovered from vessel zone 12 by conduit 20 for further separation and recovery in downstream separation equipment not shown. Catalyst particles separated in cyclones 16 are passed by dipleg 18 to the catalyst bed collected in a bottom portion of vessel 12 and in open catalyst flow communication with the lower annular catalyst stripping zone to which stripping gas is added by conduit 14 for upward flow therethrough to cyclone 16.

Catalyst particles stripped of hydrocarbon vapors are withdrawn from the bottom of the stripping zone by conduit 22 for passage to a catalyst regeneration operation generally represented by regeneration zone 24. The regeneration of the catalyst particles to remove hydrocarbonaceous deposits of hydrocarbon conversion also referred to herein as carbonaceous material or coke may be accomplished in a number of different regeneration arrangements disclosed in the prior art as a single regeneration zone as shown in FIG. 1 or preferably in a sequence of catalyst regeneration zones such as disclosed in copending applications Ser. No. 169086 and 169088 filed July 15, 1980, the subject matter of which applications is incorporated herein by reference thereto.

In the specific arrangement of FIG. 1 shown as a single regeneration zone, the catalyst bed 26 is contacted with an oxygen containing gas such as air introduced by conduit 28 to a distributor 30 and into bed 26 under conditions to achieve a controlled burning removal of hydrocarbonaceous deposits whereby the catalyst particles temperature is raised to at least about 1350° F. and a regeneration flue gas comprising CO, $CO_2$, or a mixture of CO and $CO_2$ is produced.

The regeneration flue gas comprising entrained catalyst particles pass through a dispersed catalyst phase above the dense bed of catalyst before passage through suitable cyclone separator equipment 32 to remove entrained catalyst particle fines from flue gases. The flue gases are recovered from the regeneration vessel 24 by conduit 34. Catalyst regenerated in bed 26 or in a sequence of fluid catalyst beds as herein identified and by reference to the above identified copending applications at a desired elevated temperature within the range of 1350° F. up to about 1600° F. and as high as about 1800° F. is withdrawn by conduit 8 for passage to a lower bottom portion of riser 2 thus completing the cyclic catalyst operation. Excess oxygen containing gas may be charged to the second stage of catalyst regeneration in an amount sufficient to effect some considerable ultimate cooling of catalyst particles recovered therefrom. In the arrangement of FIG. 1 it is contemplated employing hydrocarbon conversion conditions providing an outlet temperature from the riser reactor below 1600° F. and within the initial range of 900° or 950° F. up to about 1400° F. but normally not above about 1250° F. As provided above, the catalyst regeneration operation may be a two-stage regeneration operation also accomplished in a single vessel rather than two separate vessel arrangements of the above-identified applications and disclosed in the prior art. In one specific embodiment of the prior art a single vessel is shown with a separating vertical baffle member extending upwardly from the bottom of the vessel in substantially the middle thereof and of a length to permit upflow dense fluid catalyst bed regeneration of catalyst particles on one side of the vertical baffle and a second stage downflow dense fluid bed catalyst regeneration on the opposite side of the baffle to complete the regeneration of partially regenerated catalyst before passage to a hydrocarbon conversion zone such as a riser reactor zone. On the other hand, regeneration of the catalyst is more preferably completed in one of a plurality of separate and sequentially stacked on-a-common-axis regeneration arrangements disclosed in the copending application above identified.

It has been observed that a most important aspect of a hydrocarbon conversion operation is concerned with and particularly directed to obtaining rapid vaporized dispersed phase contact between the hydrocarbon feed regardless of boiling range and fluid catalyst particles under selected temperature catalytic conversion conditions. This observation however is much more important, but aggravated considerably when processing heavy residual oils comprising vacuum resid. One method for accomplishing this observation and achieving a highly atomized and substantially instantaneous vaporized contact of a high boiling residual oil feed comprising components boiling above vacuum gas oil with fluid catalyst particles is by the feed atomizing apparatus arrangement of FIG. 2 and its method of utilization.

In the apparatus arrangement of FIG. 2 there is shown in considerable detail an oil feed nozzle 4 or 6 generally shown in FIG. 1 on riser 2. The heavy oil feed nozzle is preferably positioned within a tubular sleeve means 40 which is attached to and penetrates the wall of riser 2 lined with insulating material 43. The tubular sleeve 40 is of larger diameter than the oil feed nozzle 44 and comprises a flange surface 42 to which the nozzle is attached by a matching flange 46 fastened together by bolts, a ring clamp or other suitable means not shown. The concentric nozzle arrangement of FIG. 2 positioned with the sleeve comprises a feed atomizing section "A" located external to the sleeve flange and a barrel extension "B" therefrom of sufficient length to position the open end "C" of the barrel provided with cap 60 and opening 62 on a plane adjacent to the inner vertical surface plane of the riser insulating refractory material so as to minimize abrasion of the nozzle tip with fluid catalyst particles and catalyst attrition coming in direct contact with the nozzle tip.

Referring now more particularly to FIG. 2, there is shown in detail one specific nozzle arrangement of this invention and generally represented by 4 and 6 of FIG. 1. As mentioned herein before the specific nozzle arrangement or apparatus of FIG. 2 is provided for injecting a highly atomized heavy oil feed material boiling above about 650° F. and referred to herein as a residual oil or a reduced crude oil and comprising an API gravity in the range of about 10 to 28 API. In the processing arrangement of FIG. 1 it is contemplated locating the axis of the nozzle system with respect to the riser wall in the range of 90 degrees thereto to about 30 degrees with respect to a substantially vertical axis of the riser wall.

In the specific arrangement of FIG. 2, the nozzle axis is positioned about 30 degrees from the vertical and sloping upwardly with respect to a generally vertical axis or wall of the riser reactor. In this specific embodiment, a hollow pipe sleeve 40 with a flange means 42 and otherwise open at each end thereof slopes generally upwardly and penetrates the riser reactor wall and refractory lining therein at an angle of about 30 degrees. A plurality of such sleeves comprising 2 or more thereof are positioned in a horizontal plane with respect to one another about the riser reactor wall. For example, there may be 2, 3, 4, or more of such sleeves arranged on a horizontal plane with respect to one another and spaced equally from one another about the wall of the riser reactor. The liquid oil atomizing nozzle 44 of this invention is shown coaxially positioned within a sleeve means 40 and rigidly fastened thereto through a flange member 46 as by the use of bolts, collar means or other means not shown attaching flange members 42 and 46 in matching relationship with one another. A suitable sealing gasket or annular member discussed below which will resist temperatures up to about 800° F. may be used between flange members as herein provided and desired.

The nozzle system or apparatus of this invention comprises a first atomizing and mixing section "A" external to the flange 42 of the sleeve member, a barrel member "B" which coaxially passes through said sleeve to provide an annular space "D" between said sleeve and said barrel section. A gaseous material such as steam may be added as flushing gas to the annular space to dissipate heat or displace catalyst particles falling therein. An atomized oil charge obtained as herein provided is passed by the elongated barrel section "B" to a size restricted discharge opening 62 of a size and shape selected to provide a desired spray pattern as well as discharge velocity of atomized oil as herein provided. The nozzle assembly is positioned so that the axis of opening 62 intercepts a vertical plane aligned with the inner surface of the refractory lining of the riser. On the other hand the length of the barrel may be adjusted so that opening or orifice 62 lies just inside or slightly outside the refractory lining inner vertical surface plane as required to achieve a given and preselected pattern of spray of the atomized charge within the riser without encountering excessive or unacceptable abrasion of the nozzle tip or deposition of oil spray on the riser wall.

In a preferred utilization of the specific arrangement of FIG. 2, an emulsion of water and heavy residual oil feed preheated to a suitable temperature of about 400° F. is introduced to the nozzle 44 by conduit 48 and thence is passed through an orifice opening 50 for achieving a size selected stream thereof for impingement thereof upon a cylindrical flat surface area 52 of a cylindrical member 54 extending from the wall of the mixing section "A" and opposite orifice opening 50. The diameter of the cylindrical member or rod 54 is greater in one embodiment than the diameter of orifice opening 50 so that a stream of the introduced heavy oil emulsion emitted from opening 50 will impact upon surface 52 under reduced oil surface tension conditions and be broken into relatively small droplets of oil which become dispersed within chamber "A". To further atomize the heavy oil droplets thus formed, expanded gaseous material such as steam or other suitable gaseous material is charged to chamber "A" by conduit 56 and orifice opening 58 at a right angle to the oil inlet and a velocity particularly effecting shearing contact between the oil droplet formed by impaction to form even finer droplets resembling a mist of less than 500 micron droplet size thereafter passed through the nozzle barrel "B" to end "C" and opening 62 at the tip of the nozzle. The oil droplets are further sheared and kept in highly atomized suspension by passing through restricted opening 62 adjacent to tip "C". The introduced shearing gas or steam is charged to the apparatus of FIG. 2, 90 degrees to the oil charge in this particular embodiment, and is of velocity sufficient to provide a nozzle exit velocity at size restricted opening 62 of high velocity up to about 400 ft./sec. and as high as sonic velocities. Nozzle tip opening 62 may be round or slotted as mentioned above and sized to provide a contact spray pattern of droplets within the range of 15 to 120 degrees. However, the angle between oil conduit inlet 48 and gaseous conduit inlet 56 may be less than 90 degrees to one another, but preferably at least 30 degrees.

In yet another embodiment, it is contemplated sizing the sleeve member 40 of a sufficiently larger diameter than the diameter of the nozzle barrel 44 so that the oil feed nozzle may pass through the sleeve on an axis non-parallel with the sleeve axis whereby the direction of the nozzle spray may be changed from a generally upward direction to a more horizontal direction across the riser. The directional change in the nozzle barrel may be readily accomplished by placing an annular collar not shown between flanges 42 and 46 which collar is sloped as an annular wedge as required to accomplish a desired pitch of the nozzle barrel with respect to the sleeve axis in the riser wall. The versatility of the feed nozzle pattern of spray may be further enhanced by positioning the sleeve axis on an upwardly sloping 45 degree angle with the riser wall so that a high velocity spray of finely atomized heavy oil feed into the riser for contact with upflowing fluidized particles of catalyst may include a pattern which extends over the range of horizontal dispersion substantially across the riser cross section to a pattern of spray about vertically upward through the riser interior.

In any of the nozzle arrangements and droplet spray patterns above discussed it is contemplated employing a nozzle barrel "B" length which substantially restricts the extent to which, if any, the tip of the nozzle comprising cap 60 and opening 62 extends inside the wall of the riser. In a specific embodiment, opening 62 is provided within cap 60 which screws on the end of barrel "B" or is fastened thereto by any other suitable arrangement which permits changing the cap and/or barrel to change the diameter of opening 62 as required for altering the spread of the atomized droplet spray pattern emitted therefrom at a selected velocity. It is also preferred to control the spray pattern and atomized oil discharge so that the atomized oil does not penetrate upflowing fluid particles of catalyst sufficient to contact and coke the opposite wall of the riser.

In the specific arrangement of the drawing, cylindrical member 52 may be a large diameter bolt which screws through or is otherwise attached to the wall of mixing chamber "A" for adjusting the distance between surface 52 and opening 50 to achieve desired droplet formation. On the other hand, it may be a solid rod or a "T" shaped circular member permanently fixed or adjustable which permits more unrestricted passage of atomizing gaseous material of desired velocity in shearing contact with oil droplets dispersed by the top surface of the solid rod or the "T" shaped rod. Thus the arrangement of apparatus comprising the nozzle and the rates of flow of heavy oil and atomizing gas charged thereto may be varied over a relatively wide range depending on feed viscosity and surface tension modified with water emulsified therewith to achieve desired atomization thereof to droplets of a size within the range of 2 to 500 microns thereby forming a desired fog or mist of droplets for dispersion contact with fluidized particles of catalyst in the riser reactor at a desired elevated hydrocarbon conversion temperature. It will be recognized by those skilled in the art that gasiform materials other than steam may be employed to further atomize the oil droplets of emulsion. Thus, any of the known diluent materials of the prior art may be employed, such as dry gaseous products of hydrocarbon conversion, $CO_2$, water, steam, light olefins and combinations thereof.

In yet another aspect of this invention it is recognized that improvement to obtain very fine atomization of the higher boiling portions of crude oil can be achieved by decreasing the viscosity of the oil by the addition of selected additives suitable for the purpose, separately or with added water, as above identified, to form emulsions therewith in combination with selected preheat temperatures up to 800° F.

A further embodiment of the present invention is concerned with reducing the length of the barrel portion of the nozzle arrangement. Thus it is contemplated locating the initial atomizing portion of the nozzle as close as possible to the riser wall or within the riser when positioned to extend upwardly from the bottom of the riser to minimize coalescing of droplets in the barrel. On the other hand, in the event that one would use the nozzle arrangement of this invention for discharging highly atomized high boiling crude oil and portions thereof to an upflowing dense fluid bed of catalyst particles, the wide spray pattern of atomized droplets of oil allows for a higher than usual tip exit velocity, up to at least 400 feet per second or higher, for more even penetration and dissipation in the dense fluid bed of high temperature catalyst particles.

A further important aspect of the method and apparatus used according to this invention is found in that steam and other gaseous diluents can be used to sufficiently atomize the high boiling oil feed at relatively low temperatures up to about 350° or 400° F. and sufficient to avoid undesired condensation thereof contributing to aggregation and coalescing of catalyst particles when initially contacted with atomized liquid oil feed. Thus, this will reduce coke formation significantly in a riser reactor and downstream separation steps.

Having thus generally discussed the method and apparatus of this invention and discussed specific embodiments in support thereof, it is to be understood that no undue restrictions are to be imposed by reasons thereof except as defined by the following claims.

We claim:

1. In a process for effecting the catalytic conversion of hydrocarbons to produce gasoline, lower and higher boiling hydrocarbons and effect regeneration of catalyst particles used therein to provide high temperature catalyst particles, the improvement for obtaining intimate contact between a high boiling hydrocarbon oil stream and catalyst particles recovered at a temperature of at least 1400° F. which comprises, atomizing said high boiling oil stream with gaseous material in a confined zone external to a riser hydrocarbon conversion zone, passing the atomized oil stream as an oil mist and gaseous material through an elongated confined zone terminating in a restricted diameter opening adjacent the inner surface area of the riser hydrocarbon conversion zone, said restricted diameter opening sized to further atomize said oil mist and provide a preselected spray pattern of high velocity atomized hydrocarbons within said riser zone for intimate contact with upflowing dispersed phase particles of catalyst, and separating a suspension of product hydrocarbons of cracking and catalyst particles following traverse of said riser zone for separate recovery thereof.

2. The method of claim 1 wherein said hydrocarbon oil feed comprises a residual portion of crude oil, initial atomization thereof is accomplished by direct impingement of a stream thereof on a surface area promoting droplet formation and droplets thus formed are sheared with a high velocity stream of gasiform material to form micron sized droplets of oil mist thereafter passed through said elongated confined zone to said restricted diameter opening for sprayed dispersion within said riser zone.

3. The method of claim 2 wherein said hydrocarbon feed is mixed with water to form an emulsion therewith and reduce its surface tension before effecting atomization thereof by impingement.

4. The method of claim 1 wherein the upflowing dispersed phase catalyst particles are in a fluidizing medium sufficient to provide a concentration of upflowing catalyst particles in the range of 0.5 to 10 pounds of catalyst particles per cubic foot of the riser reactor.

5. The method of claim 1 wherein said elongated confined zone housing atomized hydrocarbons penetrates the wall of the riser conversion zone at an angle within the range of 30 to 90 degrees to the riser wall.

6. The method of claim 1 wherein said atomizing zone and associated elongated confined zone is external to said riser zone and comprise an oil feed nozzle arrangement of such configuration and its method of use to accomplish complete atomization of heavy residual oil-water emulsion feed before spraying atomized droplets thereof for intimate contact with catalyst particles at an elevated cracking temperature under conditions to achieve substantially instantaneous vaporization of the charged atomized heavy residual oil-water emulsion.

7. The method of claim 1 wherein said elongated confined zone penetrates the bottom of the riser conversion zone and terminates above the catalyst particle inlet to the riser zone.

8. The method of claim 2 wherein a plurality of said hydrocarbon atomizing zones are positioned with respect to the riser zone to achieve intimate contact between atomized hydrocarbons and catalyst particles across the riser cross section under temperature conditions promoting substantially instantaneous vaporization of the atomized hydrocarbons charged.

9. The method of claim 1 wherein the dispersed phase passage of catalyst particles upwardly through the riser zone is such as to avoid formation of a dense phase of catalyst particles before and after contact with atomized hydrocarbons charged to the riser zone.

10. The method of claim 2 wherein said impingement surface area is the end of a supported surface positioned opposite the hydrocarbon inlet charge stream of oil with or without preheat thereof.

11. The method of claim 10 wherein the impingement surface area is at least equal to the diameter of said oil stream directed to impinge thereon.

12. The method of claim 10 wherein said impingement surface area is supported by a rod of smaller diameter.

13. The method of claim 10 wherein a support for said supported surface threaded or otherwise attached and passes through the wall of the atomizing zone to provide adjustment in distance between the oil stream outlet and said impingement surface area.

14. A method for catalytically converting hydrocarbons of at least gas oil boiling range to gasoline and other hydrocarbon conversion products which comprises, forming a water-hydrocarbon emulsion at a temperature below 800° F., atomizing said formed emulsion to a droplet size below about 500 microns in a zone exterior to a hydrocarbon conversion zone comprising upflowing fluid particles of catalyst, charging said atomized emulsion admixed with droplets having gaseous material at a velocity up to sonic velocity through an aperture contributing further atomization of said atomized emulsion upon discharge into said hydrocarbon conversion zone thereby promoting instantaneous vaporization contact between atomized oil droplets and fluid catalyst particles at an elevated hydrocarbon conversion temperature, and recovering gasoline and other products of said catalytic hydrocarbon conversion separate from catalyst particles.

15. The method of claim 14 wherein atomization of said water-hydrocarbon emulsion is accomplished by impingement of the emulsion in a reduced pressure zone in combination with the shearing action of a relatively high velocity gaseous stream to form a mist of oil droplets dispersed in gaseous material thereafter passed to a discharge orifice in the hydrocarbon conversion zone at a velocity sufficient to achieve discharge orifice velocities up to and including sonic velocity.

16. The method of claim 14 wherein said hydrocarbon conversion zone is a riser conversion zone through which a dispersed phase of elevated cracking temperature catalyst is passed at a particle concentration less than 10 pounds per cubic foot for contact with atomized hydrocarbon feed charged thereto.

17. The method of claim 16 wherein the elevated cracking temperature is in the range of 900° F. up to about 1600° F. and a contact time between catalyst particles and hydrocarbon feed in the riser is less than about 4 seconds.

18. The method of claim 16 wherein the ultimate sprayed dispersion of atomized hydrocarbon droplets discharged into the riser conversion is a pattern in the range of 15 to 120 degrees.

19. The method of claim 16 wherein atomized hydrocarbon droplets discharged into said riser conversion zone comprise the residual oil portion of a crude oil and the mix temperature of oil droplets and fluid catalyst particles is sufficient for substantially instantaneous vaporization cracking contact therebetween.

20. The method of claim 16 wherein the hydrocarbon feed is a residual oil comprising metallo-organic compounds boiling above 1025° F. which is mixed with up to about 2 weight percent of water to form an emulsion thereof preheated to a temperature up to about 400° F. before effecting atomization thereof.

21. The method of claim 16 wherein the spray of atomized oil droplets in the riser conversion zone is at a velocity less than sufficient to penetrate to the opposite wall of the riser the upwardly flowing suspended phase of catalyst particles of a concentration in the range of 1 to 5 pounds per cubic foot.

22. A method for effecting catalytic conversion of a residual portion of crude oil with fluidized particles of catalyst in a riser conversion zone which comprises, effecting initial atomization of said residual portion of crude oil emulsified with water by direct impingement of a stream thereof on a surface area promoting droplet formation and shearing droplets thus formed with a high velocity stream of gaseous material to a droplet size less than 500 microns in a zone external to said riser zone, passing the droplets thus formed through an elongated confined zone to a restricted opening in the end thereof adjacent the inside wall of said riser conversion zone under conditions providing an exit velocity of atomized oil droplets and gaseous material approaching sonic velocity, thereafter providing intimate contact of said atomized oil and gaseous material with upflowing fluidized high temperature particles of catalyst under temperature conditions achieving instantaneous vaporized contact of said atomized oil with said catalyst particles to produce hydrocarbon conversion products comprising gasoline, and separating hydrocarbon products of catalytic cracking from suspended catalyst particles following traverse of the riser conversion zone.

23. The method of claim 22 wherein the atomized oil droplets sprayed in the riser conversion zone extend a substantial distance across and upwardly through the riser zone for intimate contact with an upflowing dispersed phase of catalyst particles to form an upflowing suspension thereof at a temperature upon discharge from the riser conversion zone within the range of 900° to 1200° F.

* * * * *